US009287608B2

(12) United States Patent
Thompson, Jr. et al.

(10) Patent No.: US 9,287,608 B2
(45) Date of Patent: Mar. 15, 2016

(54) CARD GUIDE AND CAP ANTENNA RETENTION SYSTEM

(71) Applicant: BAE Systems Information and Electronic Systems Integration Inc., Nashua, NH (US)

(72) Inventors: Basil W. Thompson, Jr., Hooksett, NH (US); Robert D. Smith, Chelmsford, MA (US); Paul Simmons, Londonderry, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 364 days.

(21) Appl. No.: 13/870,233

(22) Filed: Apr. 25, 2013

(65) Prior Publication Data

US 2014/0015732 A1 Jan. 16, 2014

Related U.S. Application Data

(60) Provisional application No. 61/670,252, filed on Jul. 11, 2012.

(51) Int. Cl.
*H01Q 1/12* (2006.01)
*H01Q 21/00* (2006.01)

(52) U.S. Cl.
CPC ..... *H01Q 1/1207* (2013.01); *H01Q 21/0087* (2013.01); *Y10T 29/49016* (2015.01)

(58) Field of Classification Search
CPC .... H01Q 1/12; H01Q 1/1207; H01Q 21/0087
USPC ..... 343/878, 879, 886
See application file for complete search history.

(56) References Cited

U.S. PATENT DOCUMENTS

| | | | | |
|---|---|---|---|---|
| 3,216,580 | A * | 11/1965 | Fricker, Jr. | 211/41.17 |
| 5,786,792 | A * | 7/1998 | Bellus et al. | 343/770 |
| 6,891,511 | B1 * | 5/2005 | Angelucci | 343/767 |
| 2012/0313835 | A1 * | 12/2012 | Gebretnsae | 343/892 |

* cited by examiner

*Primary Examiner* — Hoang V Nguyen
*Assistant Examiner* — Daniel J Munoz
(74) *Attorney, Agent, or Firm* — Maine Cernota & Rardin; Daniel J. Long

(57) ABSTRACT

Embodiments of the present invention relate to a structure and method for providing better antenna element retention in the any environment. The structure may comprise at least two card guides attached to a base. Each card guide may have at least one antenna slot, and individual antenna elements may be guided into position by an antenna slot of two different card guides. The individual antenna elements may have their freedom of motion restricted in the direction of their insertion by caps attached to the card guides. The individual antenna elements may have their freedom of motion restricted in a direction transverse to their direction of insertion by retention members attached to the card guides. By allowing for the "top-down" assembly of individual antenna elements in a modular fashion, embodiments of the present invention may facilitate easier repair of antenna element arrays, than prior art array assemblies.

9 Claims, 3 Drawing Sheets

CARD GUIDE AND CAP ANTENNA RETENTION SYSTEM

CROSS REFERENCE TO RELATED CASE

The present invention is related to and claims the benefit of priority of U.S. Provisional Patent application No. 61/670,252, filed on Jul. 11, 2012 and entitled "Card Guide And Cap Antenna Retention System".

STATEMENT OF GOVERNMENT INTEREST

This invention was made with United States Government support under Contract No. FA8620-06-G-4028/0008 awarded by the United States Department of the Air Force. The United States Government has certain rights in this invention.

BACKGROUND OF THE INVENTION

1. Field of the Invention

The present invention relates to phased antenna arrays and more particularly to a structure and method for providing better antenna element retention in the array environment.

2. Brief Description of Prior Developments

Antenna elements are often arranged in arrays in which they are attached to a ground plate. Narrow antenna elements (also known as "card elements") like the Vivaldi Notch, do not lend themselves to a maintainable, modular array assembly. The arrays built from narrow elements are often fabricated, or printed, in sheets. In order to maintain array geometry (which is key to array performance), the sheets are inseparably attached to one another via a notch. This means that if one antenna element fails, the entire sheet must be removed in order to perform maintenance. Additionally, current arrays have cumbersome two-sided assembly requirements and a high fabrication risk due to high component cost.

A need therefore exists for a structure that allows for a more effective assembly of antenna element arrays.

SUMMARY OF THE INVENTION

When building an antenna array, maintaining antenna element spacing and support are key to array performance. There is a need to support antenna elements in a lattice array over a large area, while still controlling the mechanical response of the array when subjected to adverse mechanical loads. The present invention accomplishes this goal by providing support and alignment for antenna elements that require precise array placement, and mechanical load bearing under adverse shock and vibration conditions.

Additionally, unlike the sheet assemblies of the prior art, the present invention allows arrays to be built in a modular fashion using individual antenna elements. This modular assembly capability can reduce the size requirements for thin antenna elements, and permit them to be fabricated singularly. Additionally, in one embodiment, modular assembly will permit array assembly to take place along a single line of action from a single orientation ("top-down" assembly). This may allow for easier repair and less manipulation of the array, because an individual element can be removed, rather than having to remove an entire sheet.

Those skilled in the art will appreciate the "top down" modular assembly afforded by an embodiment of the present invention, because it maintains array geometry and controls its response to adverse mechanical loads, while facilitating easy repair with less manipulation.

BRIEF DESCRIPTION OF THE DRAWINGS

Embodiments of the invention, as well as a preferred mode of use, will best be understood by reference to the following detailed description of an illustrative embodiment when read in conjunction with the accompanying drawings, wherein.

DETAILED DESCRIPTION OF A PREFERRED EMBODIMENT

Figure 1:
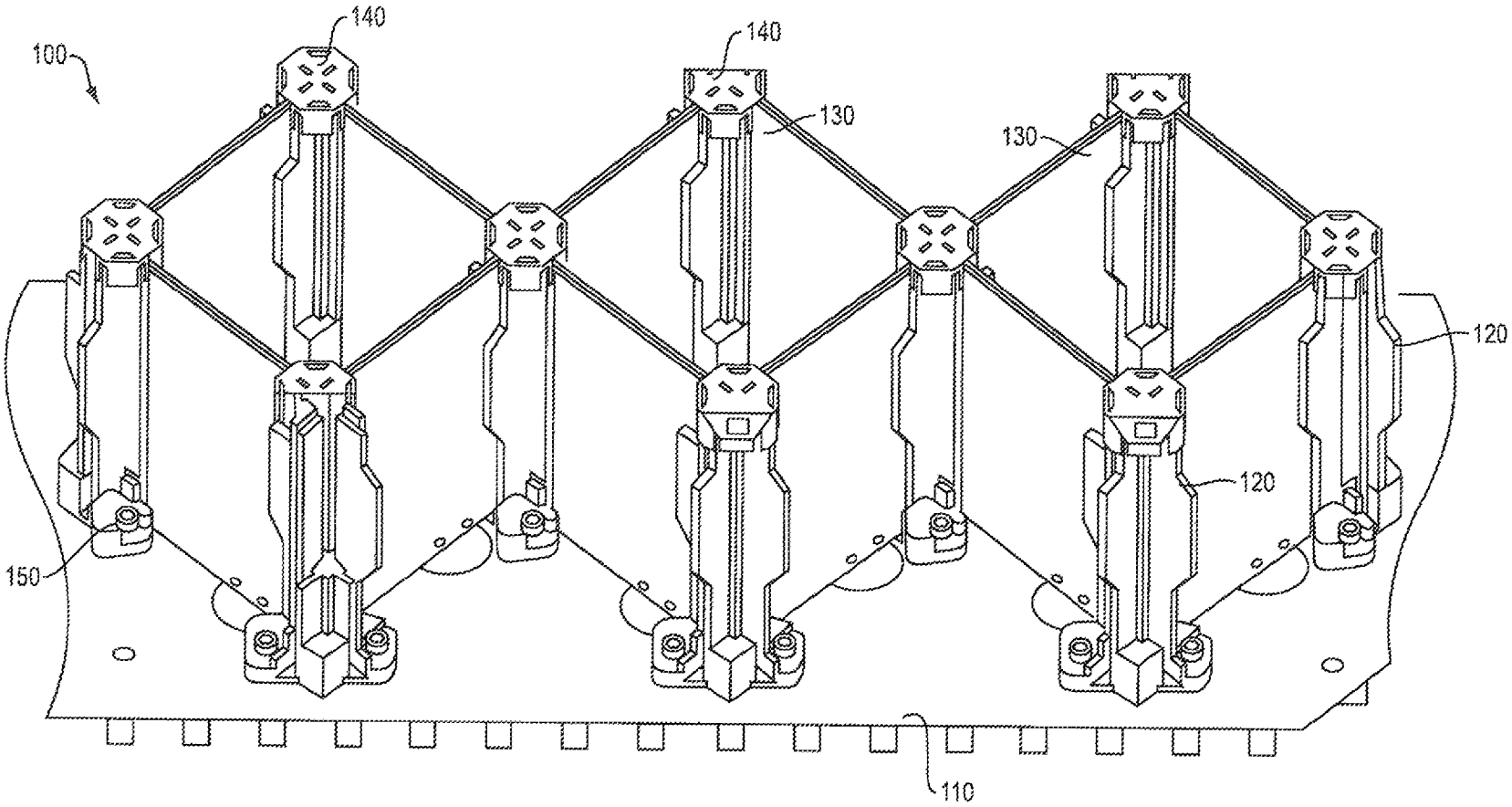
FIG. 1 shows an antenna element array assembly in accordance with an embodiment of the present invention.
Figure 2:
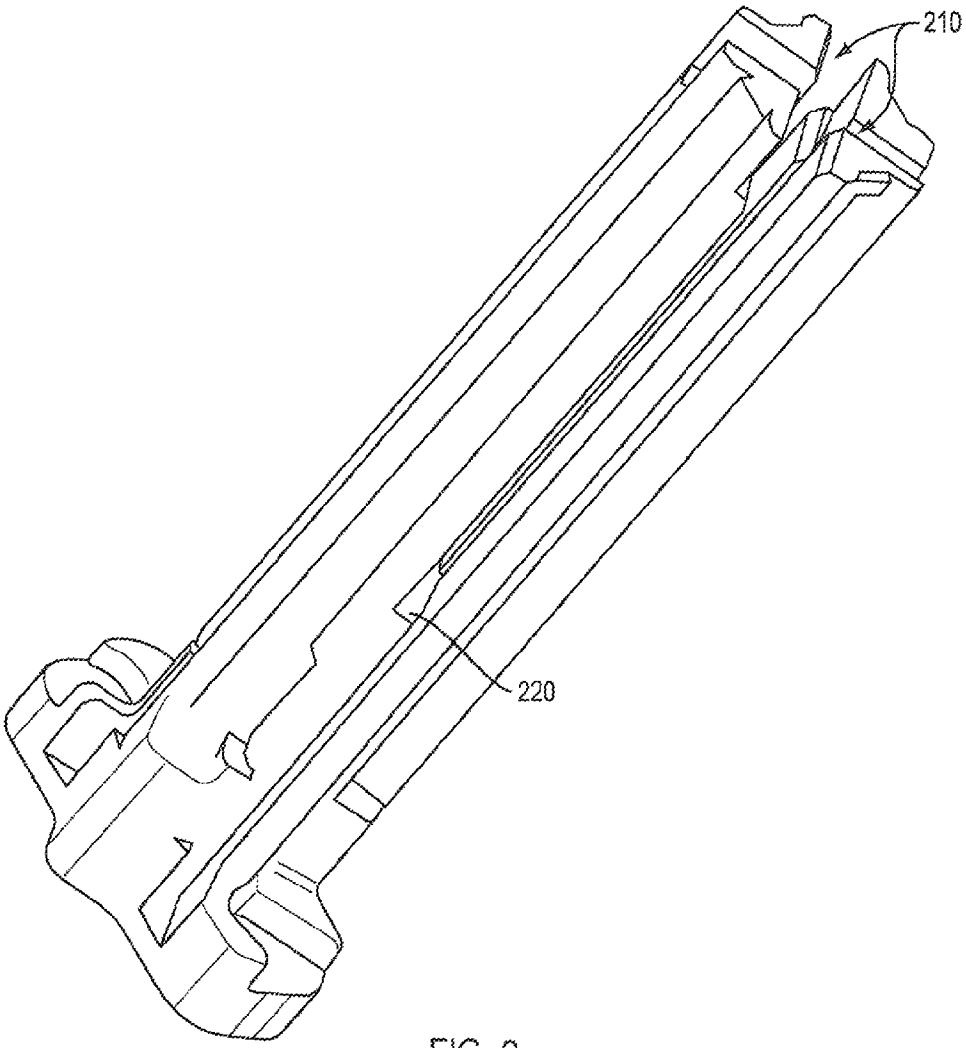
FIG. 2 shows an example card guide structure in accordance with an embodiment of the present invention.

Referring now to the drawings, FIG. 1 shows an antenna element array assembly 100 in accordance with an embodiment of the present invention. The assembly 100 may have at least two card guides 120 that are attached to a base 110. For example, the attachment may be done via screws 150, or other attachment techniques known in the industry. Individual antenna elements 130 are guided into position by antenna slots 210 located on the card guides 120 as shown in FIG. 2. The individual antenna elements 130 may have their freedom of motion restricted in the direction of their insertion by a cap 140 that may be attached to each of the card guides 120. The individual antenna elements 130 may have their freedom of motion restricted in a direction transverse to the direction of their insertion by retention members 220 attached to the card guides 120 as shown in FIG. 2, in one embodiment, both the card guides 120 and the caps 140 are made of a non-metallic material. The assembly of FIG. 1 allows for individual antenna elements 130 to be assembled in a modular fashion along a single line of action from a single orientation ("top-down" assembly).

If an individual antenna element 130 needs to be removed, an embodiment of the present invention provides an easy solution. After the caps holding the element in place are removed, just the individual element for which removal is required can be slid out of the antenna slots, while all other antenna elements remain in place. Subsequently, either a new or a repaired element can be slid back into the antenna slots and held in place with either the same caps or new ones.

FIG. 2 shows a more detailed view of an example card guide 120 of an embodiment of the present invention. The card guide may contain at least one antenna slot 210. Having multiple antenna slots 210 can allow single card guide to help retain multiple antenna elements, as can be seen in FIG. 1. The card guide may contain a retention member 220 for restricting the freedom of motion of the individual antenna elements in a direction transverse to the element's direction of insertion. The retention member 220 may be, for example, a spring loaded retention member.

Figure 3:
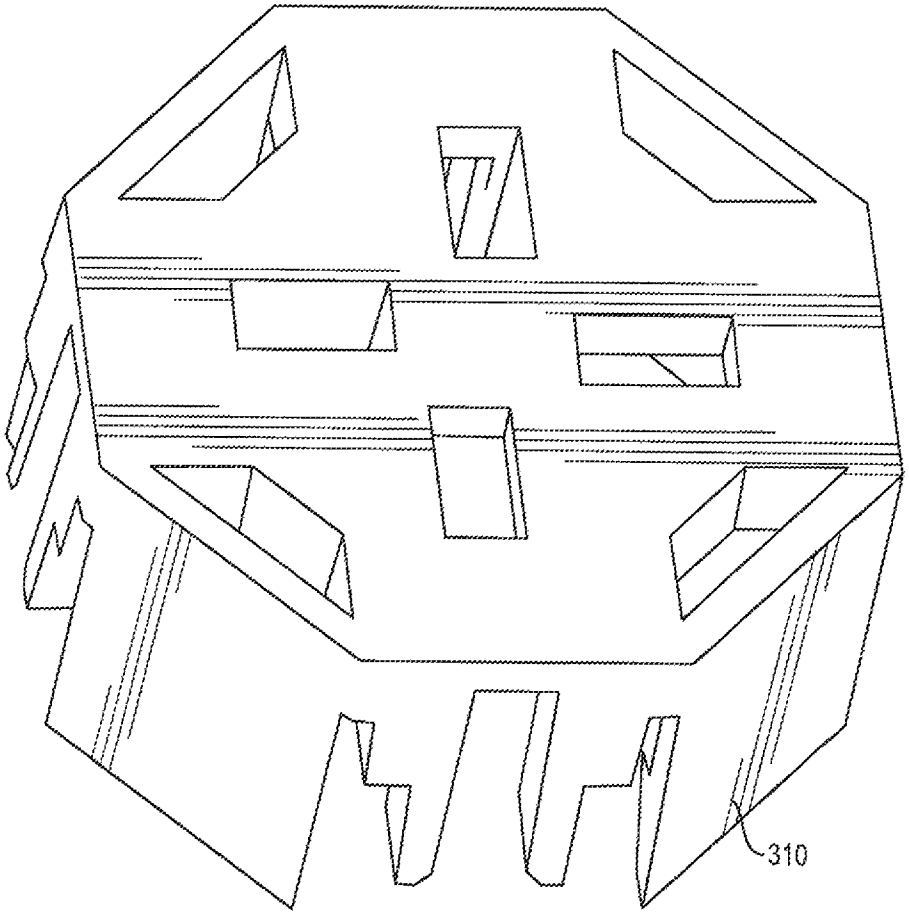
FIG. 3 shows an example cap structure in accordance with an embodiment of the present invention.

FIG. 3 shows a more detailed view of an example cap 140 of an embodiment of the present invention. In one embodiment, the cap is removed by causing the mechanical failure of a tab 310 that is part of the cap. This mechanical failure ensures that the cap cannot be reused, and must be replaced.

In an embodiment of the present invention, adjustments can be made to the various components—card guides, caps, and retention members to tune the mechanical compliance of the antenna element array to accommodate various mechanical shock and vibration environments.

While the present invention has been described in connection with the preferred embodiments of the various figures, it is to be understood that other similar embodiments may be used or modifications and additions may be made to the described embodiment for performing the same function of the present invention without deviating there from. Therefore, the present invention should not be limited to any single embodiment, but rather construed in breadth and scope in accordance with the recitation or the appended claims.

What is claimed is:

1. An antenna element retention structure comprising:

a base;

at least two card guides mounted to said base, wherein each of said at least two card guides has at least one antenna slot; and at least one antenna element configured for separable insertion into said antenna slots, wherein an individual antenna element is guided into position by an antenna slot of two different card guides and may be removed therefrom without the removal of any adjacent antenna elements; each card guide further comprising an individually removable cap configured to restrict said individual antenna element's freedom of motion in the direction of said individual antenna element's insertion.

2. The antenna element retention structure of claim 1 wherein said at least two card guides are made of a non-metallic material.

3. The antenna element retention structure of claim 1 wherein said cap is made of a non-metallic material.

4. The antenna element retention structure of claim 1 wherein said cap further comprises a tab configured to secure said cap to said card during normal usage and to mechanically fail upon the removal of said cap therefrom.

5. The antenna element retention structure of claim 1 further comprising a retention member attached to each of said at least two card guides to restrict said individual antenna element's freedom of motion in a direction transverse to the direction of said individual antenna element's insertion.

6. The antenna element retention structure of claim 5 wherein said retention member is a spring loaded retention member.

7. The antenna element retention structure of claim 1 wherein said at least two card guides are attached to said base via at least one screw.

8. The antenna element retention structure of claim 1 wherein the placement and orientation of said at least two card guides allows for a top-down assembly of an antenna element array.

9. The antenna element retention structure of claim 1 wherein the placement and orientation of said at least two card guides allows for a modular assembly of an antenna element array.

* * * * *